US007004117B2

(12) United States Patent
Grant

(10) Patent No.: US 7,004,117 B2
(45) Date of Patent: Feb. 28, 2006

(54) FUEL PUMP WITH COOLING FINS

(76) Inventor: Barry S. Grant, Rte. 1, Box 1900, Dahlonega, GA (US) 30533

( * ) Notice: Subject to any disclaimer, the term of this patent is extended or adjusted under 35 U.S.C. 154(b) by 0 days.

(21) Appl. No.: 10/735,100

(22) Filed: Dec. 12, 2003

(65) Prior Publication Data

US 2004/0141858 A1 Jul. 22, 2004

Related U.S. Application Data

(60) Provisional application No. 60/433,120, filed on Dec. 13, 2002.

(51) Int. Cl.
*F01P 1/06* (2006.01)

(52) U.S. Cl. ..... 123/41.31; 123/541

(58) Field of Classification Search ..... 123/41.31, 123/541

See application file for complete search history.

(56) References Cited

U.S. PATENT DOCUMENTS 2,152,091 A * 3/1939 Rockwell ..... 123/41.31
4,915,063 A * 4/1990 Stumpf ..... 123/41.31

* cited by examiner

*Primary Examiner*—F. Daniel Lopez
(74) *Attorney, Agent, or Firm*—Thomas, Kayden, Horstemeyer & Risley, LLP

(57) ABSTRACT

Cooling fins 72, 74 and 76 extend about the fuel pump 24, perpendicular to the longitudinal axis of the fuel pump and parallel to the anticipated direction of flow of the air stream generated by the movement of the vehicle. The cooling fins are formed on the pump bowl 36, hood 34, and mounting arm 49 to extract the heat of conduction transferred from the engine block 12 to the mounting arm 49 and heat of radiation and convection transferred from the engine block and its accessories to the pump bowl 36, hood 34 and mounting arm 49.

9 Claims, 4 Drawing Sheets

FUEL PUMP WITH COOLING FINS

CROSS REFERENCE

Applicant claims the benefit of Provisional Patent Application Ser. No. 60/433,120, filed Dec. 13, 2002.

FIELD OF THE INVENTION

This invention involves the cooling of fuel as the fuel passes through a fuel pump from the gas tank or fuel cell to the carburetor or fuel injectors of an internal combustion engine. More particularly, the invention involves the use of cooling fins disposed about the external surfaces of a fuel pump.

BACKGROUND OF THE INVENTION

During the operation of a self-propelled vehicle driven by an internal combustion reciprocating engine, particularly a high performance vehicle, the engine and its components become hot. There is a hazard that the heat from the engine and other components of the vehicle will cause the fuel, such as gasoline, being delivered to the engine to be heated to a point where it tends to vaporize before it is distributed to the carburetor or fuel injectors. This tends to cause an interruption of the fuel flow to the engine, and this causes the engine to surge or otherwise malfunction.

The fuel coming from the fuel cell or gas tank travels through the fuel line from the rear of the vehicle along the frame and then moves to one side of the engine where the fuel pump is located and is connected to the fuel pump. Usually, the fuel pump is mounted on a lower front portion of the engine block, in the general area adjacent the exhaust manifolds. The fuel line from the fuel pump to the carburetor extends upwardly from the fuel pump and about the engine block, past the water pump and the exhaust manifolds. As the engine and its components operate, they emit a large amount of heat at high temperatures, usually higher that the boiling temperature of the fuel. This tends to heat the fuel lines leading toward and away from the fuel pump and the fuel flowing through the fuel lines.

As the fuel passes through the fuel pump, additional heat is added to the fuel by the action of the pump and by the conduction transfer of heat from the engine block to the fuel pump, and then as the fuel passes upwardly from the fuel pump around the engine block, it receives more heat from the engine block as well as from the water pump.

If the total amount of heat absorbed by the fuel in the fuel line and in the fuel pump exceeds the vaporization temperature of the fuel, the fuel tends to vaporize and that forms a vapor lock in the line leading to the carburetor or fuel injectors.

In order to maintain the fuel at a temperature low enough to avoid vaporization of the fuel, fuel lines have been extended through a "cool can," which is container about the size of a coffee can, with the fuel line arranged in a coil in the can. Ice is packed in the can about the coiled fuel line so that the ice contacts the helically wound portion of the fuel line. The fuel is cooled as it passes through the cool can. This is a temporary fix for high performance vehicles used in racing situations and does not solve the problem of vapor lock on a more permanent basis.

It is to the above noted problems that this invention is directed.

SUMMARY OF THE INVENTION

Briefly described, the present invention comprises a fuel pump for a combustion engine of a self propelled vehicle. The fuel pump includes a housing configured for mounting to the combustion engine of the vehicle, the housing having a curved exterior surface. The housing includes a plurality of heat transfer fins extending externally of the housing and oriented in a direction that is compatible with the expected direction of the air passing about the fuel pump in response to the forward movement of the vehicle and the air movement from the radiator fan.

A feature of the invention is that the fuel pump comprises a diaphragm pump having a pump housing that is generally of cylindrical exterior configuration, with the cooling fins extending about the circular housing, parallel to the diaphragm of the fuel pump.

The cooling fins extend from the fuel pump and are oriented approximately parallel to the expected flow of air, so as to channel the air between the fins and about the housing for maximum heat transfer, inducing the heat from inside the fuel pump to be dissipated by the cooling fins.

Preferably the heat transfer fins will substantially encircle the housing so that the cooling air tends to travel about the curved housing in the channels between the cooling fins. Preferably, the cooling fins are interrupted only by inlet and outlet ports and other necessary interruptions to facilitate the mounting and operation of the fuel pump.

DETAILED DESCRIPTION

Figure 1:
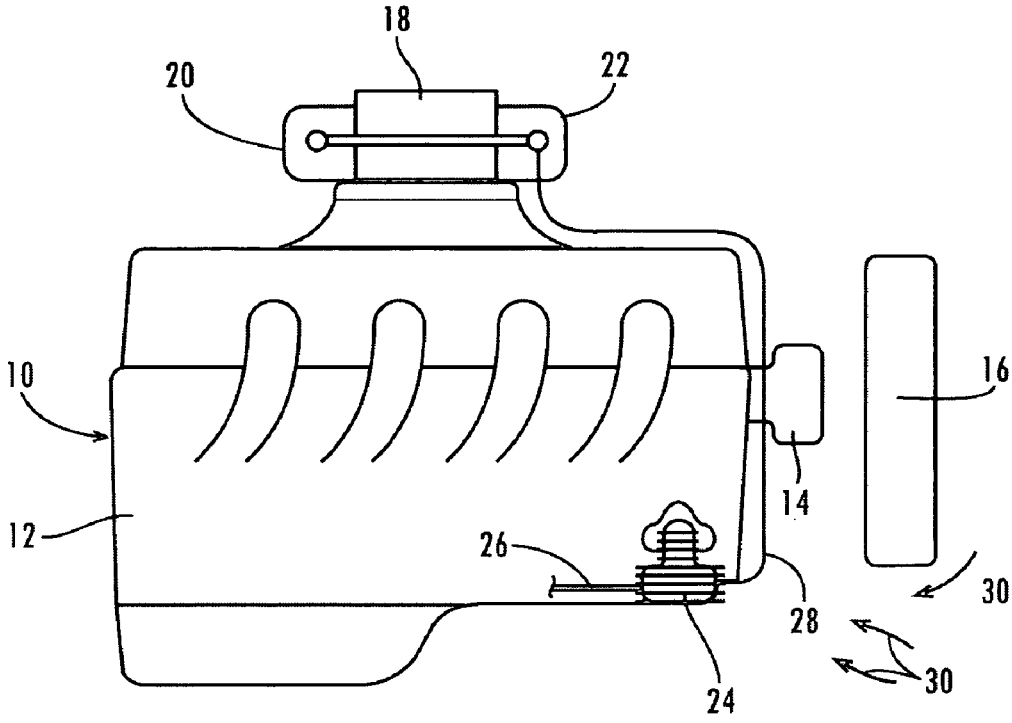
FIG. 1 is a side view of an internal combustion engine and some of its associated components, including the fuel pump mounted to the lower forward portion of the engine.

Referring now in more detail to the drawings in which like numerals indicate like parts throughout the several views, FIG. 1 illustrates an internal combustion engine 10 having an engine block 12, a water pump 14, radiator 16, carburetor 18, fuel bowls 20 and 22, and a fuel pump 24. Fuel pump 24 is mounted to the lower front of the engine block 12, and a first fuel line 26 extends from the fuel tank or fuel cell (not shown) to the pump 24 and a second fuel line 28 extends from the fuel pump 24 up to the fuel bowls 20 and 22.

The fuel pump 24 is mounted adjacent the lower portion of the engine block 12 at a position where a stream of air indicated by arrows 30 usually passes the exterior of the engine block, in the direction indicated by the arrows, beneath and about the radiator and bumper and other components at the lower front of the vehicle. The stream of air is generated by the forward movement of the vehicle across the ground surface, and the direction of the air stream 30 is substantially predictable and constant during the normal operation of the vehicle.

In this particular fuel pump application, the vehicle is a high performance vehicle, used in drag racing or oval track racing, for example, and the stream of air 30 usually reaches above 100 miles per hour relative to the fuel pump 24.

Figure 2:
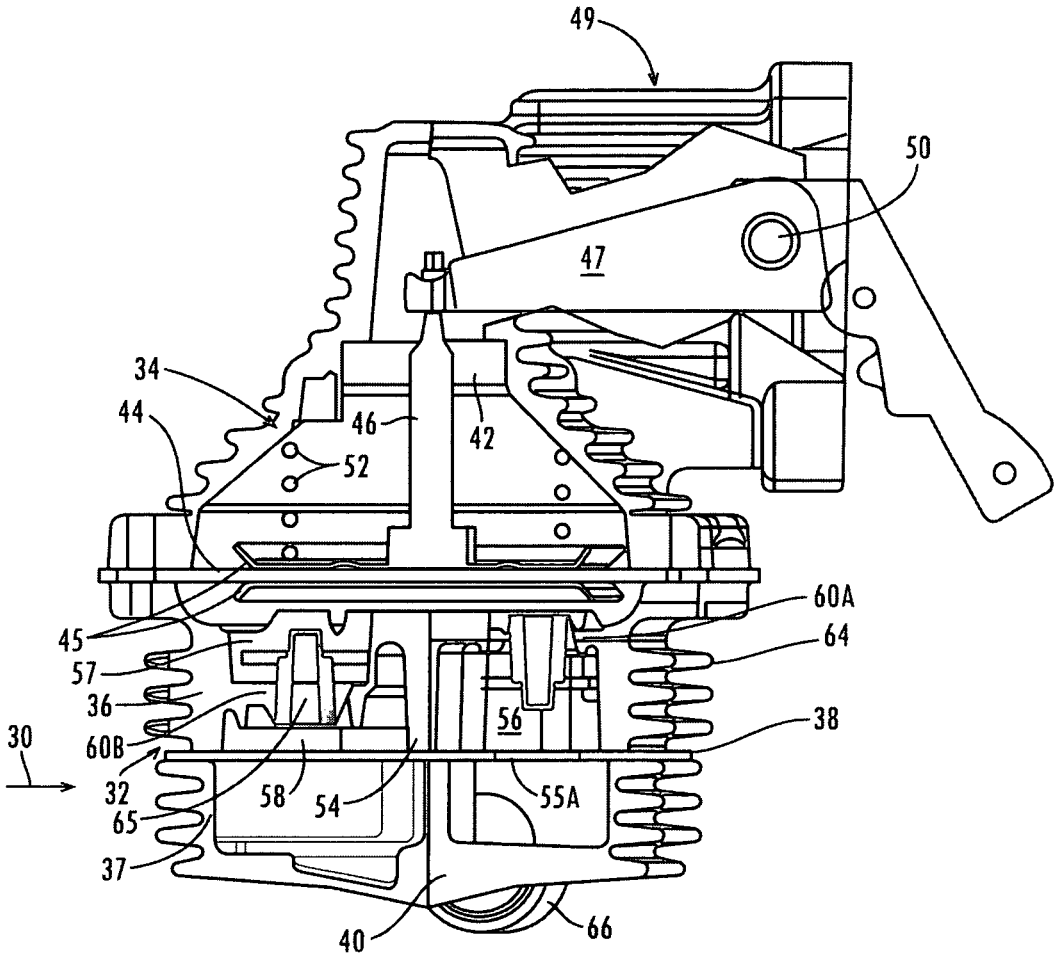
FIG. 2 is a side cross-sectional view of the fuel pump.
Figure 3:
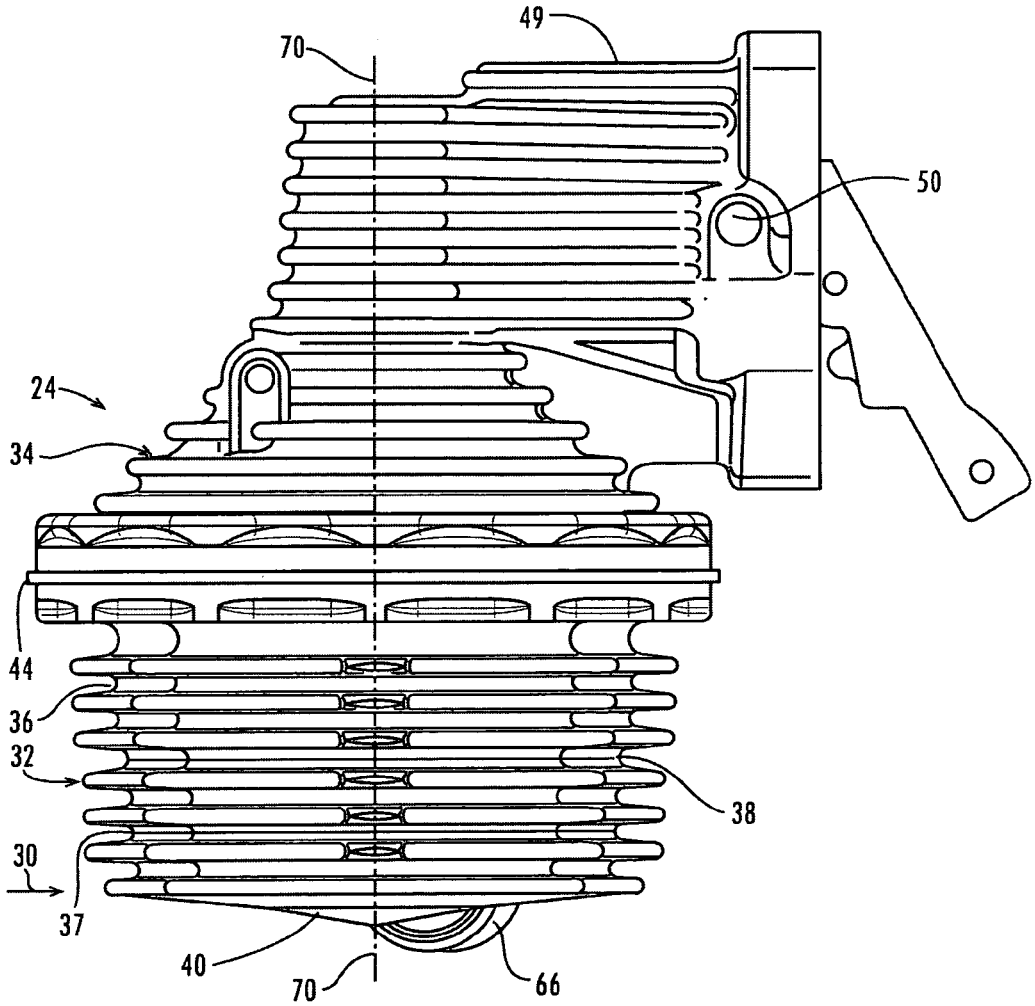
FIG. 3 is a side view of the exterior of the fuel pump of FIG. 2.
Figure 4:
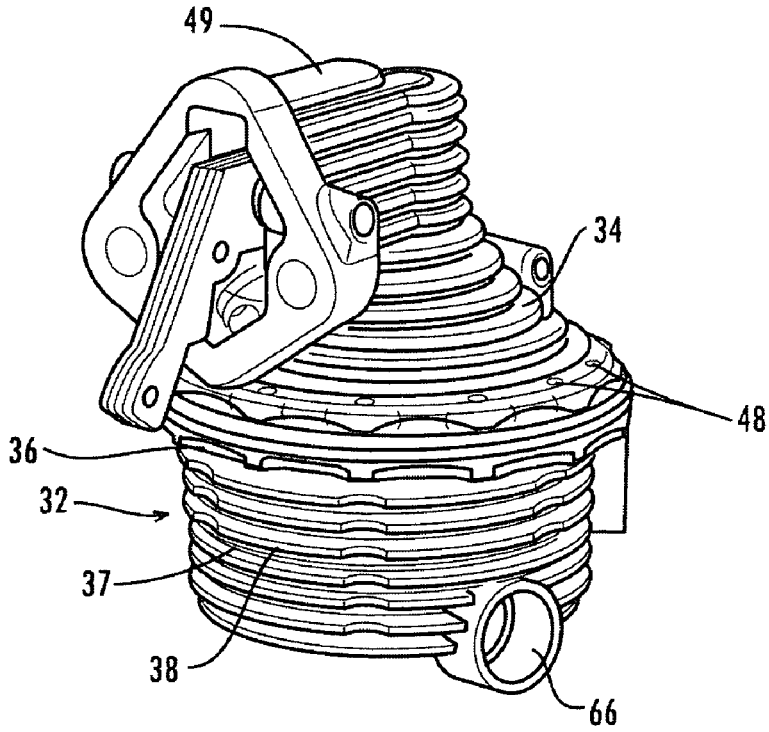
FIG. 4 is a perspective view of the back, inlet side and upper portion of the fuel pump.

As illustrated in FIGS. 2 and 3, the fuel pump can be a diaphragm pump that is operated by the engine of the vehicle. The pump includes a pump housing 32 that is formed from component parts, including hollow mounting arm 49, hood 34, pump bowl 36, inlet bowl 37, gasket 38, bottom wall 40, oil seal 42, and diaphragm 44. The parts of the pump housing 32 are held together by connecting bolts 48 (FIG. 4). Hollow mounting arm 49 suspends the pump housing 32 away from the engine block 12.

Diaphragm push rod 46 is connected at its lower end to the central portion of diaphragm 44 by diaphragm push plates 45 and extends upwardly through the hood 34. The push rod 46 of diaphragm 44 is actuated by the laterally extending actuator arm 47 that pivots about pivot pin 50 in the internal hollow portion of the mounting arm 49. The actuator arm imparts vertical reciprocating movement to the push rod and the push rod to the central portion of the diaphragm. The actuator arm 47 is engaged and operated by a cam of the engine (not shown).

A coil compression spring 52 is mounted in the hood 34 about the push rod 46 to constantly urge the diaphragm in a downward, fuel delivery motion. The actuator arm 47 functions to lift the push rod 46 and the diaphragm 44 to provide the upward reciprocation movement and draw the fuel into the pump bowl. The diaphragm functions as an impeller for moving the fuel through the pump.

In the disclosed embodiment the pump bowl 36 and inlet bowl 37 are cylindrically shaped and separator gasket 55 seals the bowl 36 and 37 together at their rims. The gasket 55 separates the pump bowl from the inlet bowl on the left of the drawing of FIG. 2 and a gasket opening 55A on the right of the drawing of FIG. 2 allows fuel to pass from fuel inlet bowl 37 to the pump bowl 36. Fuel inlet 66 communicates with the fuel inlet bowl at a position below the gasket 38, and fuel outlet 68 communicates with the pump bowl above the gasket 38. The pump bowl includes a partition 54 that divides the pump bowl into an inlet chamber 56, a pump chamber 57, and an outlet chamber 58. Valve wall 60A extends horizontally across pump bowl 36 and a plurality of fuel transfer ports (only one shown) are formed in the valve wall 60A and one-way valves 64 that permit the flow of fuel from inlet chamber 56 through the transfer ports into the pump chamber 57, and fuel transfer ports include one-way valves 65 that permit the flow of fuel through the valve transfer ports 62D–62F, into outlet chamber 58.

With the structure as described herein and illustrated in the drawings, it can be seen that the reciprocation of the diaphragm causes the flow of fuel from inlet 66 into inlet bowl 37, upwardly through the opening 55A of gasket 55 and into inlet chamber 56 of pump bowl 36, through fuel the transfer ports and their one-way directional inlet valves 64 into the pump chamber 57, and then downwardly through the fuel transfer ports and their one-way directional outlet valves 65 into outlet chamber 58, and out of the outlet opening 68.

Figure 5:
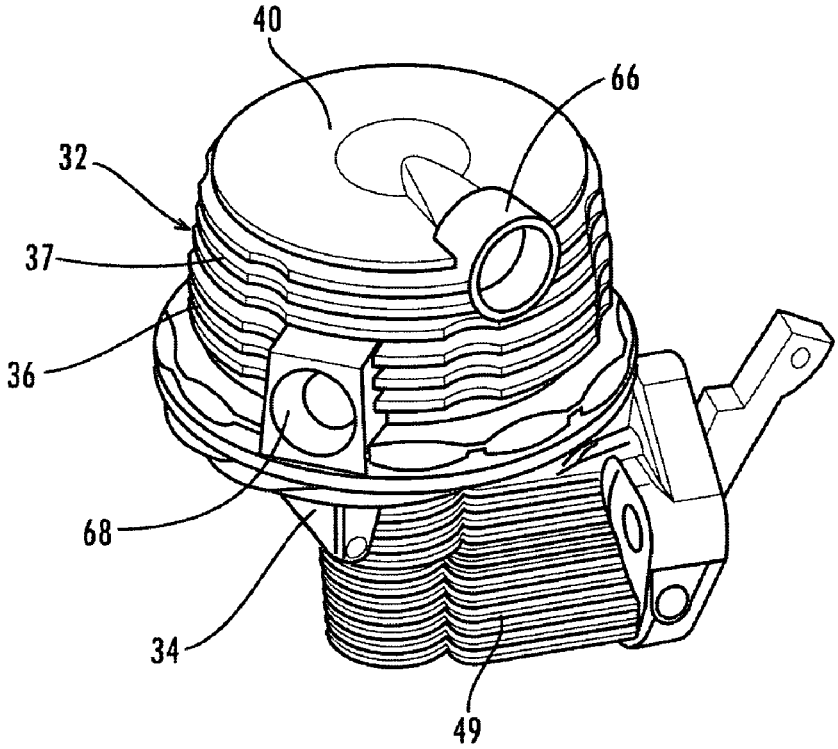
FIG. 5 shows the fuel pump turned up side down, showing a perspective view of the front, outlet side and lower portion of the pump.

Important features of the invention are the heat transfer or cooling fins 72, 74 and 76 that surround and extend radially from the fuel pump 24. The embodiment illustrated, exterior of the pump housing 32 is round, substantially cylindrical, as shown in FIG. 5, although other shapes can be used. Preferably the shape of the pump bowl 36 is symmetrical with a central or longitudinal axis 70. Cooling fins 72 of the pump bowl and the cooling fins 74 of the hood 34 are perpendicular to the longitudinal axis 70, and extend radially out from and circumferentially around and substantially surround pump bowl 36. Similar cooling fins 74 surround conically shaped hood 34 that is mounted atop pump bowl 36. Additional cooling fins 76 extend about the mounting arm 49. All of the fins 72, 74 and 76 are parallel to each other and perpendicular to the longitudinal axis 70. The cooling fins are parallel to the diaphragm 44. Also, as can be seen in FIG. 1, the fuel pump 24 is mounted so that its cooling fins 72, 74 and 76 extend approximately parallel to the direction of the air stream 30 that is created when the vehicle is moving in a forward direction.

The diaphragm 44 that is positioned between the pump bowl 36 and the hood 34, and the inlet chamber 56, pump chamber 57 and outlet chamber 58, require the major breadth dimensions of the fuel pump 24. The placement of the cooling fins perpendicular to the longitudinal axis assures that the maximum effective surface area of the cooling fins is presented to the atmosphere about the greatest breadth of the fuel pump.

The cooling fins form channels between themselves that are approximately parallel to the anticipated air stream 30, and the circular configuration of the fuel pump 24 and the cooling fins 72, 74 induce the air to be directed around the circular shape of the fuel pump 24, at least around the hood 34 and pump bowl 36. With this arrangement, more heat transfer surfaces are presented to the onrushing air stream 30, and the heat of the fuel pump can be transferred from the cooling fins to the air stream more expediently, thereby minimizing the increase in temperature of the fuel moving from the fuel tank to the carburetor.

The cooling fins are positioned on all of the pump bowl 36, the hood 34 and hollow mounting arm 49. The placement of cooling fins on the hollow mounting arm and on the hood allows for the extraction of heat of conduction that comes from the engine block 12 that might otherwise travel through the mounting arm and hood and be transferred to the fuel passing through the pump chamber 57. The placement of cooling fins about the pump bowl 36 allows for extraction of heat from the portion of the pump that is in the most intimate contact with the fuel flowing through the pump.

Although the fuel pump has been described as having a cylindrical pump bowl and a conical hood, it can be formed in other shapes, such as oval, conical and other symmetrical shapes that are compatible with its operation and compatible with the placement cooling fins parallel to one another and about the pump housing for optimum heat transfer.

Although a preferred embodiment of the invention has been disclosed in detail herein, it will be obvious to those skilled in the art that variations and modifications of the disclosed embodiment can be made without departing from the spirit and scope of the invention as set forth in the following claims.

I claim:

1. A fuel pump assembly for a combustion engine, comprising:

a pump housing, a hollow mounting arm connected to said pump housing configured for mounting to a combustion engine for supporting said fuel pump assembly on said combustion engine, said pump housing having a longitudinal axis and a curved exterior surface substantially co-axial with respect to said longitudinal axis, a flexible diaphragm in said pump housing, a diaphragm actuator in said hollow mounting arm for reciprocating said diaphragm positioned in said pump housing, said diaphragm extending substantially normal to said longitudinal axis and having a central portion movable substantially parallel to said longitudinal axis in response to the movement of said diaphragm actuator, said pump housing including a plurality of heat transfer fins extending externally of said pump housing and oriented parallel to said diaphragm, so that air tends to be guided by said fins about the pump housing, a plurality of heat transfer fins extending externally of said hollow mounting arm for exchanging heat with the atmosphere and reducing the transfer of heat from the combustion engine through the hollow mounting arm to the pump housing to reduce the likelihood of vaporization of fuel moved through the fuel pump.

2. The fuel pump assembly of claim 1, wherein said heat transfer fins substantially encircle said pump housing and form there between air channels that substantially encircle said pump housing for guiding air about said pump housing.

3. The fuel pump assembly of claim 1, wherein said pump housing includes a pump bowl and a hood, both of which include said heat transfer fins.

4. The fuel pump assembly of claim 1, wherein said pump bowl includes inlet and outlet ports, and said heat transfer fins are interrupted by said inlet and outlet ports.

5. A fuel pump assembly for a combustion engine comprising:

a pump housing, said pump housing having a longitudinal axis, including:

a pump bowl including an exterior wall substantially coaxial with respect to said longitudinal axis, a hood mounted to said pump bowl and substantially coaxial with respect to said longitudinal axis, a diaphragm mounted between said pump bowl and said hood and extending normal to said longitudinal axis and having a central portion movable parallel to said longitudinal axis, a mounting arm connected to said hood for mounting said pump housing and said hood to the combustion engine.

a plurality of parallel heat transfer fins extending externally of said pump bowl, said hood and said mounting arm substantially encircling said pump bowl and said hood and projecting from said mounting arm for the transfer of heat received from the combustion engine to the surrounding air before the heat moves through the mounting arm to said pump housing, and said pump bowl including inlet and outlet ports.

6. The fuel pump assembly of claim 5, wherein said heat transfer fins extend normal to said longitudinal axis, and said heat transfer fins being interrupted by said inlet and outlet ports.

7. A fuel pump assembly of claim 5, and further comprising:

a mounting arm extending from said hood for mounting said fuel pump to an engine block, and cooling fins extending from said mounting arm for extracting heat conducted from the engine block to the mounting arm.

8. A fuel pump assembly for an internal combustion engine of an automobile, the engine having an exterior surface at which atmospheric air tends to flow in an approximately constant direction in response to the movement of the automobile in a forward direction, said fuel pump comprising:

a pump housing, a diaphragm in said housing, a fuel inlet port and a fuel outlet port extending through said pump housing for moving fuel into and out of said pump housing, a mounting arm connected to said pump housing for mounting said pump housing to the internal combustion engine, a diaphragm actuator extending through said mounting arm.

a plurality of cooling fins extending from said pump housing and from said mounting arm, said cooling fins that extend from said pump housing being oriented substantially parallel to the anticipated direction of the flow of the air at the exterior surface of the engine for channeling the air about said pump housing and increasing the transfer of heat from said pump housing.

9. The fuel pump assembly of claim 8, wherein said diaphragm extends parallel to said cooling fins.

* * * * *